US008978334B2

(12) United States Patent
Engstrom

(10) Patent No.: US 8,978,334 B2
(45) Date of Patent: Mar. 17, 2015

(54) SET OF PANELS

(71) Applicant: Pergo (Europe) AB, Trelleborg (SE)

(72) Inventor: Nils-Erik Engstrom, Trelleborg (SE)

(73) Assignee: Pergo (Europe) AB, Trelleborg (SE)

( * ) Notice: Subject to any disclaimer, the term of this patent is extended or adjusted under 35 U.S.C. 154(b) by 0 days.

(21) Appl. No.: 14/223,365

(22) Filed: Mar. 24, 2014

(65) Prior Publication Data

US 2014/0283476 A1 Sep. 25, 2014

Related U.S. Application Data

(63) Continuation of application No. 13/086,931, filed on Apr. 14, 2011, now Pat. No. 8,720,148.

(30) Foreign Application Priority Data

May 10, 2010 (DE) ..... 10 2010 020 089

(51) Int. Cl.
*E04F 15/02* (2006.01)
*E04F 15/04* (2006.01)

(52) U.S. Cl.
CPC ..... *E04F 15/02038* (2013.01); *E04F 15/02* (2013.01); *E04F 15/04* (2013.01); *E04F 2201/0138* (2013.01); *E04F 2201/0153* (2013.01); *E04F 2201/0523* (2013.01)
USPC ..... 52/582.1; 52/391; 52/588.1

(58) Field of Classification Search
CPC ..... E04F 15/02; E04F 15/02005; E04F 15/02038
USPC ..... 52/391, 582.1, 582.2, 584.1, 587.1, 52/586.1, 586.2, 585.1; 428/50
See application file for complete search history.

(56) References Cited

U.S. PATENT DOCUMENTS 208,036 A 9/1878 Robley
213,740 A 4/1879 Conner
(Continued)

FOREIGN PATENT DOCUMENTS

AU 199732569 12/1999
AU 200020703 6/2000
(Continued)

OTHER PUBLICATIONS

Knight's American Mechanical Dictionary, vol. III. 1876, definition of "scarf".
(Continued)

*Primary Examiner* — William Gilbert
(74) *Attorney, Agent, or Firm* — Jenkins, Wilson, Taylor & Hunt, P.A.

(57) ABSTRACT

The invention relates to a set of panels, in particular floor panels, comprising a first panel and at least a second panel. The panels are respectively provided with a first edge and with a second edge, wherein the first edge and the second edge are configured to establish a connection between the first and the second panel. The first edge can have a lower lip with a step, and the second edge can have a downwardly open locking groove. A separate clip can be provided which can be attached to the first edge or the second edge and has a moveable clip head, which in the connected state of the panels can cooperate with a locking surface on the second edge or the first edge, respectively, in order to lock the panels vertically relative to the plane of laying.

13 Claims, 2 Drawing Sheets

(56) References Cited

U.S. PATENT DOCUMENTS

| | | | |
|---|---|---|---|
| 308,313 | A | 11/1884 | Gerike |
| 342,529 | A | 5/1886 | McRae |
| 502,289 | A | 8/1893 | Feldman |
| 662,458 | A | 11/1900 | Nagel |
| 714,987 | A | 12/1902 | Wolfe |
| 752,694 | A | 2/1904 | Lund |
| 753,791 | A | 3/1904 | Fulghum |
| 769,355 | A | 9/1904 | Platow |
| 832,003 | A | 9/1906 | Torrence |
| 847,272 | A | 3/1907 | Ayers |
| 877,639 | A | 1/1908 | Galbraith |
| 898,381 | A | 9/1908 | Mattison |
| 1,000,859 | A | 8/1911 | Vaughan |
| 1,002,102 | A | 8/1911 | Weedon |
| 1,016,383 | A | 2/1912 | Wellman |
| 1,097,986 | A | 5/1914 | Moritz |
| 1,124,226 | A | 1/1915 | Houston |
| 1,124,228 | A | 1/1915 | Houston |
| 1,137,197 | A | 4/1915 | Ellis |
| 1,140,958 | A | 5/1915 | Cowan |
| 1,266,253 | A | 5/1918 | Hakason |
| 1,319,286 | A | 10/1919 | Johnson et al. |
| 1,357,713 | A | 11/1920 | Lane |
| 1,407,679 | A | 2/1922 | Ruchrauff |
| 1,454,250 | A | 5/1923 | Parsons |
| 1,468,288 | A | 9/1923 | Fen |
| 1,510,924 | A | 10/1924 | Daniels et al. |
| 1,540,128 | A | 6/1925 | Houston |
| 1,575,821 | A | 3/1926 | Daniels |
| 1,576,527 | A | 3/1926 | McBride |
| 1,576,821 | A | 3/1926 | Daniels |
| 1,602,256 | A | 10/1926 | Sellin |
| 1,602,267 | A | 10/1926 | Karwisde |
| 1,615,096 | A | 1/1927 | Myers |
| 1,622,103 | A | 3/1927 | Fulton |
| 1,622,104 | A | 3/1927 | Fulton |
| 1,637,634 | A | 8/1927 | Carter |
| 1,644,710 | A | 10/1927 | Crooks |
| 1,657,159 | A | 1/1928 | Greenebaum |
| 1,660,480 | A | 2/1928 | Daniels |
| 1,706,924 | A | 3/1929 | Kane |
| 1,714,738 | A | 5/1929 | Smith |
| 1,718,702 | A | 6/1929 | Pfiester |
| 1,734,826 | A | 11/1929 | Pick |
| 1,736,539 | A | 11/1929 | Lachman |
| 1,764,331 | A | 6/1930 | Moratz |
| 1,772,417 | A | 8/1930 | Ellinwood |
| 1,776,188 | A | 9/1930 | Langbaum |
| 1,823,039 | A | 9/1930 | Gruner |
| 1,778,069 | A | 10/1930 | Fetz |
| 1,787,027 | A | 12/1930 | Wasleff |
| 1,801,093 | A | 4/1931 | Larkins |
| 1,843,024 | A | 1/1932 | Werner |
| 1,854,396 | A | 4/1932 | Davis |
| 1,859,667 | A | 5/1932 | Gruner |
| 1,898,364 | A | 2/1933 | Gynn |
| 1,906,411 | A | 5/1933 | Potvin |
| 1,913,342 | A | 6/1933 | Schaffert |
| 1,929,871 | A | 10/1933 | Jones |
| 1,940,377 | A | 12/1933 | Storm |
| 1,953,306 | A | 4/1934 | Moratz |
| 1,966,020 | A | 7/1934 | Rowley |
| 1,978,075 | A | 10/1934 | Butterworth |
| 1,986,739 | A | 1/1935 | Mitte |
| 1,988,201 | A | 1/1935 | Hall |
| 1,991,701 | A | 2/1935 | Roman |
| 2,004,193 | A | 6/1935 | Cherry |
| 2,015,813 | A | 10/1935 | Nielsen |
| 2,027,292 | A | 1/1936 | Rockwell |
| 2,044,216 | A | 6/1936 | Klages |
| 2,045,067 | A | 6/1936 | Bruce |
| 2,049,571 | A | 8/1936 | Schuck |
| 2,100,238 | A | 11/1937 | Burgess |
| 2,126,956 | A | 8/1938 | Gilbert |
| 2,138,085 | A | 11/1938 | Birtles |
| 2,141,708 | A | 12/1938 | Elmendorf |
| 2,142,305 | A | 1/1939 | Davis |
| 2,194,086 | A | 3/1940 | Horn |
| 2,199,938 | A | 5/1940 | Kloote |
| 2,222,137 | A | 11/1940 | Bruce |
| 2,238,169 | A | 4/1941 | Heyn et al. |
| 2,245,497 | A | 6/1941 | Potchen |
| 2,253,943 | A | 8/1941 | Rice |
| 2,266,464 | A | 12/1941 | Kraft |
| 2,276,071 | A | 3/1942 | Scull |
| 2,280,071 | A | 4/1942 | Hamilton |
| 2,282,559 | A | 5/1942 | Byers |
| 2,324,628 | A | 7/1943 | Kahr |
| 2,363,429 | A | 11/1944 | Lowry |
| 2,398,632 | A | 4/1946 | Frost et al. |
| 2,405,602 | A | 8/1946 | Nugent |
| 2,430,200 | A | 11/1947 | Wilson |
| 2,487,571 | A | 11/1949 | Maxwell |
| 2,491,498 | A | 12/1949 | Kahr |
| 2,644,552 | A | 7/1953 | MacDonanld |
| 2,717,420 | A | 9/1955 | Georges |
| 2,729,584 | A | 1/1956 | Foster |
| 2,740,167 | A | 4/1956 | Rowley |
| 2,780,253 | A | 2/1957 | Joa |
| 2,805,852 | A | 9/1957 | Ewert |
| 2,808,624 | A | 10/1957 | Sullivan |
| 2,823,433 | A | 2/1958 | Kendall |
| 2,839,790 | A | 6/1958 | Collings |
| 2,857,302 | A | 10/1958 | Burton et al. |
| 2,863,185 | A | 12/1958 | Reidi |
| 2,865,058 | A | 12/1958 | Ake Andersson et al. |
| 2,878,530 | A | 3/1959 | Hilding |
| 2,894,292 | A | 7/1959 | Gramelspacher |
| 2,926,401 | A | 3/1960 | Place |
| 2,831,223 | A | 9/1960 | DeShazor |
| 2,952,341 | A | 9/1960 | Weiler |
| 2,996,751 | A | 8/1961 | Roby |
| 3,045,294 | A | 7/1962 | Livezey, Jr. |
| 3,090,082 | A | 5/1963 | Bauman |
| 3,100,556 | A | 8/1963 | Ridder |
| 3,125,138 | A | 3/1964 | Bolenbach |
| 3,128,851 | A | 4/1964 | Deridder et al. |
| 3,141,392 | A | 7/1964 | Schneider |
| 3,148,482 | A | 9/1964 | Neale |
| 3,162,906 | A | 12/1964 | Dudley |
| 3,182,769 | A | 5/1965 | De Ridder |
| 3,199,258 | A | 8/1965 | Jentoft et al. |
| 3,203,149 | A | 8/1965 | Soddy |
| 3,204,380 | A | 9/1965 | Wilson |
| 3,253,377 | A | 5/1966 | Schakel |
| 3,257,225 | A | 6/1966 | Marotta |
| 3,267,630 | A | 8/1966 | Omholt |
| 3,282,010 | A | 11/1966 | King, Jr. |
| 3,286,425 | A | 11/1966 | Brown |
| 3,296,056 | A | 1/1967 | Bechtold |
| 3,301,147 | A | 1/1967 | Aluminum |
| 3,310,919 | A | 3/1967 | Bue |
| 3,331,171 | A | 7/1967 | Hallock |
| 3,339,329 | A | 9/1967 | Berg |
| 3,347,048 | A | 10/1967 | Brown et al. |
| 3,362,127 | A | 1/1968 | McGowan |
| 3,363,381 | A | 1/1968 | Forrest |
| 3,363,382 | A | 1/1968 | Forrest |
| 3,363,383 | A | 1/1968 | La Barge |
| 3,373,071 | A | 3/1968 | Fuerst |
| 3,377,931 | A | 4/1968 | Hilton |
| 3,385,182 | A | 5/1968 | Harvey |
| 3,387,422 | A | 6/1968 | Wanzer |
| 3,397,496 | A | 8/1968 | Sohns |
| 3,444,660 | A | 5/1969 | Feichter |
| 3,449,879 | A | 6/1969 | Bloom |
| 3,460,304 | A | 8/1969 | Braeuninger et al. |
| 3,473,278 | A | 10/1969 | Gossen |
| 3,474,584 | A | 10/1969 | Lynch |
| 3,479,784 | A | 11/1969 | Massagli |
| 3,481,810 | A | 12/1969 | Waite |
| 3,488,828 | A | 1/1970 | Gallagher |
| 3,496,119 | A | 2/1970 | Fitzgerald |
| 3,508,369 | A | 4/1970 | Tennison |

(56) References Cited

U.S. PATENT DOCUMENTS 3,526,420 A 9/1970 Brancaleone
3,535,844 A 10/1970 Glaros
3,538,665 A 11/1970 Gohner
3,538,819 A 11/1970 Gould et al.
3,553,919 A 1/1971 Omholt
3,555,762 A 1/1971 Costanzo, Jr.
3,570,205 A 3/1971 Payne
3,572,224 A 3/1971 Perry
3,579,941 A 5/1971 Tibbals
3,619,964 A 11/1971 Passaro et al.
3,627,362 A 12/1971 Brenneman
3,657,852 A 4/1972 Worthington et al.
3,665,666 A 5/1972 Delcroix
3,671,369 A 6/1972 Kvalheim et al.
3,687,773 A 8/1972 Wangborg
3,694,983 A 10/1972 Couquet
3,696,575 A 10/1972 Armstrong
3,707,061 A 12/1972 Collette et al.
3,714,747 A 2/1973 Curran
3,720,027 A 3/1973 Christensen
3,731,445 A 5/1973 Hoffmann et al.
3,745,726 A 7/1973 Thom
3,758,650 A 9/1973 Hurst
3,759,007 A 9/1973 Thiele
3,760,544 A 9/1973 Hawes et al.
3,768,846 A 10/1973 Hensley et al.
3,778,958 A 12/1973 Fowler
3,798,111 A 3/1974 Lane et al.
3,807,113 A 4/1974 Turner
3,808,030 A 4/1974 Bell
3,810,707 A 5/1974 Tungseth et al.
3,849,240 A 11/1974 Mikulak
3,859,000 A 1/1975 Webster
3,884,328 A 5/1975 Williams
3,902,293 A 9/1975 Witt et al.
3,908,053 A 9/1975 Hettich
3,908,062 A 9/1975 Roberts
3,921,312 A 11/1975 Fuller
3,936,551 A 2/1976 Elmendorf et al.
3,953,661 A 4/1976 Gulley
3,988,187 A 10/1976 Witt et al.
4,059,933 A 11/1977 Funk et al.
4,060,437 A 11/1977 Strout
4,065,902 A 1/1978 Lindal
4,067,155 A 1/1978 Ruff et al.
4,074,496 A 2/1978 Fischer
4,090,338 A 5/1978 Bourgade
4,099,358 A 7/1978 Compaan
4,143,498 A 3/1979 Martin et al.
4,144,689 A 3/1979 Bains
4,150,517 A 4/1979 Warner
4,158,335 A 6/1979 Belcastro
4,164,832 A 8/1979 Van Zandt
4,169,688 A 10/1979 Toshio
4,186,539 A 2/1980 Harmon et al.
4,198,455 A 4/1980 Spiro et al.
4,242,390 A 12/1980 Nemeth
4,247,390 A 1/1981 Knoll
4,292,774 A 10/1981 Mairle
4,299,070 A 11/1981 Oltmanns et al.
4,316,351 A 2/1982 Ting
4,376,593 A 3/1983 Schaefer
4,390,580 A 6/1983 Donovan et al.
4,426,820 A 1/1984 Terbrack et al.
4,449,346 A 5/1984 Tremblay
4,455,803 A 6/1984 Kornberger
4,461,131 A 7/1984 Pressell
4,471,012 A 9/1984 Maxwell
4,501,102 A 2/1985 Knowles
4,504,347 A 3/1985 Munk et al.
4,505,887 A 3/1985 Miyata et al.
4,520,062 A 5/1985 Ungar et al.
4,561,233 A 12/1985 Harter et al.
4,571,910 A 2/1986 Cosentino
4,594,347 A 6/1986 Ishikawa et al.
4,599,124 A 7/1986 Kelly et al.
4,599,841 A 7/1986 Haid
4,599,842 A 7/1986 Counihan
4,612,745 A 9/1986 Hovde
4,621,471 A 11/1986 Kuhr et al.
4,641,469 A 2/1987 Wood
4,643,237 A 2/1987 Rosa
4,653,138 A 3/1987 Carder
4,653,242 A 3/1987 Ezard
4,672,728 A 6/1987 Nimberger
4,683,631 A 8/1987 Dobbertin
4,703,597 A 11/1987 Eggemar
4,715,162 A 12/1987 Brightwell
4,733,510 A 3/1988 Werner
4,736,563 A 4/1988 Bilhorn
4,738,071 A 4/1988 Ezard
4,747,197 A 5/1988 Charron
4,754,658 A 7/1988 Gutknecht
4,757,657 A 7/1988 Mitchell
4,757,658 A 7/1988 Kaempen
4,769,963 A 9/1988 Meyerson
4,796,402 A 1/1989 Pajala
4,806,435 A 2/1989 Athey
4,819,932 A 4/1989 Trotter, Jr.
4,819,935 A 4/1989 Dirksing et al.
4,831,806 A 5/1989 Niese et al.
4,844,972 A 7/1989 Tedeschi et al.
4,845,907 A 7/1989 Meek
4,893,449 A 1/1990 Kemper
4,894,272 A 1/1990 Aisley
4,905,442 A 3/1990 Daniels
4,910,280 A 3/1990 Robbins, III
4,920,626 A 5/1990 Nimberger
4,940,503 A 7/1990 Lindgren et al.
4,952,775 A 8/1990 Yokoyama et al.
4,953,335 A 9/1990 Kawaguchi et al.
4,988,131 A 1/1991 Wilson et al.
4,998,395 A 3/1991 Bezner
4,998,396 A 3/1991 Palmersten
5,003,016 A 3/1991 Boeder
5,029,425 A 7/1991 Bogataj
5,034,272 A 7/1991 Lindgren et al.
5,050,362 A 9/1991 Tal et al.
5,070,662 A 12/1991 Niese
5,074,089 A 12/1991 Kemmer et al.
5,086,599 A 2/1992 Meyerson
5,092,095 A 3/1992 Zadok
5,113,632 A 5/1992 Hanson
5,117,603 A 6/1992 Weintraub
5,138,812 A 8/1992 Palmersten
5,148,850 A 9/1992 Urbanick
5,155,952 A 10/1992 Herwegh et al.
5,165,816 A 11/1992 Parasin
5,179,811 A 1/1993 Walker et al.
5,179,812 A 1/1993 Hill
5,216,861 A 6/1993 Meyerson
5,244,303 A 9/1993 Hair
5,247,773 A 9/1993 Weir
5,253,464 A 10/1993 Nilsen
5,259,162 A 11/1993 Nicholas
5,271,564 A 12/1993 Smith
5,274,979 A 1/1994 Tsai
5,292,155 A 3/1994 Bell et al.
5,295,341 A 3/1994 Kajiwara
5,325,649 A 7/1994 Kajiwara
5,343,665 A 9/1994 Palmersten
5,344,700 A 9/1994 McGath et al.
5,348,778 A 9/1994 Knipp et al.
5,349,796 A 9/1994 Meyerson
5,359,817 A 11/1994 Fulton
5,365,713 A 11/1994 Nicholas et al.
5,390,457 A 2/1995 Sjolander
5,424,118 A 6/1995 McLaughlin
5,425,302 A 6/1995 Levrai et al.
5,433,048 A 7/1995 Strasser
5,433,806 A 7/1995 Pasquali et al.
5,474,831 A 12/1995 Nystrom
5,497,589 A 3/1996 Porter
5,502,939 A 4/1996 Zadok et al.

(56) References Cited

U.S. PATENT DOCUMENTS 5,527,128 A 6/1996 Rope et al.
5,540,025 A 7/1996 Takehara et al.
D373,203 S 8/1996 Kornfalt
5,567,497 A 10/1996 Zegler et al.
5,570,554 A 11/1996 Searer
5,581,967 A 12/1996 Glatz
5,597,024 A 1/1997 Bolyard et al.
5,618,602 A 4/1997 Nelson
5,618,612 A 4/1997 Gstrein
5,623,799 A 4/1997 Kowalski
5,630,304 A 5/1997 Austin
5,657,598 A 8/1997 Wilbs et al.
5,671,575 A 9/1997 Wu
5,685,117 A 11/1997 Nicholson
5,688,569 A 11/1997 Gilmore et al.
5,692,354 A 12/1997 Searer
5,695,875 A 12/1997 Larsson et al.
5,706,621 A 1/1998 Pervan
5,706,623 A 1/1998 Brown
5,719,239 A 2/1998 Mirous et al.
5,735,092 A 4/1998 Clayton et al.
5,736,227 A 4/1998 Sweet et al.
5,765,808 A 6/1998 Butschbacher et al.
5,791,114 A 8/1998 Mandel
5,797,237 A 8/1998 Finkell, Jr.
5,823,240 A 10/1998 Bolyard et al.
5,827,592 A 10/1998 Van Gulik et al.
5,860,267 A 1/1999 Pervan
5,888,017 A 3/1999 Corrie
5,894,701 A 4/1999 Delorme
5,904,019 A 5/1999 Kooij et al.
5,907,934 A 6/1999 Austin
5,930,947 A 8/1999 Eckhoff
5,931,447 A 8/1999 Butschbacher et al.
5,935,668 A 8/1999 Smith
5,941,047 A 8/1999 Johansson
5,943,239 A 8/1999 Shamblin et al.
5,945,181 A 8/1999 Fisher
5,950,389 A 9/1999 Porter
5,968,625 A 10/1999 Hudson
5,971,655 A 10/1999 Shirakawa
5,987,839 A 11/1999 Hamar et al.
5,987,845 A 11/1999 Laronde
5,996,301 A 12/1999 Conterno
6,006,486 A 12/1999 Moriau et al.
6,012,263 A 1/2000 Church et al.
6,021,615 A 2/2000 Brown
6,021,646 A 2/2000 Burley
6,023,907 A 2/2000 Pervan
6,029,416 A 2/2000 Andersson
6,079,182 A 6/2000 Ellenberger
6,094,882 A 8/2000 Pervan
6,101,778 A 8/2000 Martensson
6,119,423 A 9/2000 Costantino
6,134,854 A 10/2000 Stanchfield
6,141,920 A 11/2000 Kemper
6,143,119 A 11/2000 Seidner
6,148,884 A 11/2000 Bolyard et al.
6,158,915 A 12/2000 Kise
6,182,410 B1 2/2001 Pervan
6,182,413 B1 2/2001 Magnusson
6,189,283 B1 2/2001 Bentley
6,205,639 B1 3/2001 Pervan
6,209,278 B1 4/2001 Tychsen
6,216,403 B1 4/2001 Belbeoc'h
6,216,409 B1 4/2001 Roy et al.
6,219,982 B1 4/2001 Eyring
6,230,385 B1 5/2001 Nelson
6,233,899 B1 5/2001 Mellert et al.
6,247,285 B1 6/2001 Moebus
6,253,514 B1 7/2001 Jobe et al.
6,314,701 B1 11/2001 Meyerson
6,324,803 B1 12/2001 Pervan
6,324,809 B1 12/2001 Nelson
6,332,733 B1 12/2001 Hamberger et al.
6,345,480 B1 2/2002 Kemper
6,345,481 B1 2/2002 Nelson
6,363,677 B1 4/2002 Chen et al.
6,365,258 B1 4/2002 Alm
6,365,936 B1 4/2002 Shimabukuro et al.
6,385,936 B1 5/2002 Schneider
6,397,547 B1 6/2002 Martensson
6,418,683 B1 7/2002 Martensson et al.
6,421,970 B1 7/2002 Martensson et al.
6,423,257 B1 7/2002 Stobart
6,438,919 B1 8/2002 Knauseder
6,446,405 B1 9/2002 Pervan
6,497,079 B1 12/2002 Pletzer et al.
6,505,452 B1 1/2003 Hannig et al.
6,510,665 B2 1/2003 Pervan
6,516,579 B1 2/2003 Pervan
6,517,935 B1 2/2003 Kornfalt et al.
6,532,709 B2 3/2003 Pervan
6,536,178 B1 3/2003 Palsson
6,550,205 B2 4/2003 Neuhofer
6,588,165 B1 7/2003 Wright
6,588,166 B2 7/2003 Martensson et al.
6,591,568 B1 7/2003 Palsson
6,601,359 B2 8/2003 Olofsson
6,606,834 B2 8/2003 Martensson et al.
6,647,690 B1 11/2003 Martensson
6,672,030 B2 1/2004 Schulte
6,681,820 B2 1/2004 Olofsson
6,682,254 B1 1/2004 Olofsson
6,711,869 B2 3/2004 Tychsem
6,729,091 B1 5/2004 Martensson
6,745,534 B2 6/2004 Kornfalt
6,763,643 B1 7/2004 Martensson
6,769,219 B2 8/2004 Schwitte et al.
6,769,835 B2 8/2004 Stridsman
6,786,016 B1 9/2004 Wood
6,805,951 B2 10/2004 Kornfalt et al.
6,851,241 B2 2/2005 Pervan
6,854,235 B2 2/2005 Martensson
6,860,074 B2 3/2005 Stanchfield
6,880,305 B2 4/2005 Pervan et al.
6,880,307 B2 4/2005 Schwitte et al.
6,898,913 B2 5/2005 Pervan
6,920,732 B2 7/2005 Martensson
6,931,798 B1 8/2005 Pocai
6,966,161 B2 11/2005 Palsson et al.
RE38,950 E 1/2006 Maiers et al.
7,021,019 B2 4/2006 Knauseder
7,086,205 B2 8/2006 Pervan
7,121,058 B2 10/2006 Palsson et al.
7,121,059 B2 10/2006 Pervan
7,131,242 B2 11/2006 Martensson
7,152,507 B2 12/2006 Solari
7,210,272 B2 5/2007 Friday
7,332,053 B2 2/2008 Palsson et al.
7,347,328 B2 3/2008 Hartwall
7,398,628 B2 7/2008 Van Horne
7,441,385 B2 10/2008 Palsson et al.
7,451,578 B2 11/2008 Hannig
7,454,875 B2 * 11/2008 Pervan et al. ..... 52/586.2
7,497,058 B2 3/2009 Martensson
7,552,568 B2 6/2009 Palsson et al.
7,603,826 B1 10/2009 Moebus
7,634,884 B2 12/2009 Pervan et al.
7,665,267 B2 2/2010 Moriau et al.
7,726,088 B2 6/2010 Muehlebach
7,820,287 B2 10/2010 Kornfalt et al.
7,856,784 B2 12/2010 Martensson
7,856,785 B2 12/2010 Pervan
7,877,956 B2 2/2011 Martensson
7,980,039 B2 7/2011 Groeke et al.
7,980,043 B2 7/2011 Moebus
8,006,458 B1 8/2011 Olofsson et al.
8,028,486 B2 10/2011 Pervan et al.
8,037,657 B2 10/2011 Sjoberg et al.
8,038,363 B2 10/2011 Hannig et al.
8,117,795 B2 2/2012 Knauseder
8,146,318 B2 4/2012 Palsson
8,234,834 B2 8/2012 Martensson et al.

(56) References Cited

U.S. PATENT DOCUMENTS

| | | | |
|---|---|---|---|
| 8,276,342 | B2 | 10/2012 | Martensson |
| 8,402,709 | B2 | 3/2013 | Martensson |
| 8,429,869 | B2 | 4/2013 | Pervan |
| 8,544,233 | B2 | 10/2013 | Palsson |
| 8,578,675 | B2 | 11/2013 | Palsson |
| 8,615,952 | B2 | 12/2013 | Engstrom |
| 8,631,623 | B2 | 1/2014 | Engstrom |
| 8,720,148 | B2 | 5/2014 | Engstrom |
| 8,789,334 | B2 | 7/2014 | Moriau et al. |
| 2001/0029720 | A1 | 10/2001 | Pervan |
| 2002/0007608 | A1 | 1/2002 | Pervan |
| 2002/0046526 | A1 | 4/2002 | Knauseder |
| 2002/0046528 | A1 | 4/2002 | Pervan et al. |
| 2002/0095895 | A1 | 7/2002 | Daly et al. |
| 2002/0100242 | A1 | 8/2002 | Olofsson |
| 2002/0112433 | A1 | 8/2002 | Pervan |
| 2002/0127374 | A1 | 9/2002 | Spratling |
| 2002/0148551 | A1 | 10/2002 | Knauseder |
| 2002/0178673 | A1 | 12/2002 | Pervan |
| 2002/0178674 | A1 | 12/2002 | Pervan |
| 2002/0178681 | A1 | 12/2002 | Zancai et al. |
| 2002/0178682 | A1 | 12/2002 | Pervan |
| 2002/0189747 | A1 | 12/2002 | Steinwender |
| 2003/0009972 | A1 | 1/2003 | Pervan et al. |
| 2003/0024199 | A1 | 2/2003 | Pervan et al. |
| 2003/0033784 | A1 | 2/2003 | Pervan |
| 2003/0084634 | A1 | 5/2003 | Stanchfield |
| 2003/0084636 | A1 | 5/2003 | Pervan |
| 2003/0094230 | A1 | 5/2003 | Sjoberg |
| 2003/0118812 | A1 | 6/2003 | Kornfalt |
| 2003/0141004 | A1 | 7/2003 | Palmblad |
| 2003/0145540 | A1 | 8/2003 | Brunedal |
| 2003/0154678 | A1 | 8/2003 | Stanchfield |
| 2003/0159389 | A1 | 8/2003 | Kornfalt |
| 2003/0224147 | A1 | 12/2003 | Maine et al. |
| 2004/0016197 | A1 | 1/2004 | Ruhdorfer |
| 2004/0031225 | A1 | 2/2004 | Fowler |
| 2004/0031226 | A1 | 2/2004 | Miller |
| 2004/0031227 | A1 | 2/2004 | Knauseder |
| 2004/0040235 | A1 | 3/2004 | Kurtz |
| 2004/0041225 | A1 | 3/2004 | Nemoto |
| 2004/0139678 | A1 | 7/2004 | Pervan |
| 2004/0182036 | A1 | 9/2004 | Sjoberg et al. |
| 2004/0191461 | A1 | 9/2004 | Riccobene |
| 2004/0211143 | A1 | 10/2004 | Hanning |
| 2005/0034405 | A1 | 2/2005 | Pervan |
| 2005/0144881 | A1 | 7/2005 | Tate |
| 2005/0166526 | A1 | 8/2005 | Stanchfield |
| 2005/0210810 | A1 | 9/2005 | Pervan |
| 2005/0252130 | A1 | 11/2005 | Martensson |
| 2006/0101769 | A1 | 5/2006 | Pervan |
| 2006/0236642 | A1 | 10/2006 | Pervan |
| 2006/0248836 | A1 | 11/2006 | Martensson |
| 2007/0006543 | A1 | 1/2007 | Engstrom |
| 2007/0028547 | A1 | 2/2007 | Grafenauer et al. |
| 2007/0240376 | A1 | 10/2007 | Engstrom |
| 2008/0000186 | A1 | 1/2008 | Pervan |
| 2008/0134613 | A1 | 6/2008 | Pervan |
| 2008/0216434 | A1 | 9/2008 | Pervan |
| 2008/0236088 | A1* | 10/2008 | Hannig ..... 52/592.1 |
| 2008/0271403 | A1 | 11/2008 | Palsson |
| 2009/0019806 | A1 | 1/2009 | Muehlebach |
| 2009/0064624 | A1 | 3/2009 | Sokol |
| 2009/0100782 | A1 | 4/2009 | Groeke et al. |
| 2009/0193748 | A1 | 8/2009 | Boo et al. |
| 2009/0199500 | A1 | 8/2009 | LeBlang |
| 2009/0217615 | A1 | 9/2009 | Engstrom |
| 2010/0031599 | A1 | 2/2010 | Kennedy et al. |
| 2010/0043333 | A1 | 2/2010 | Hannig |
| 2010/0058700 | A1 | 3/2010 | LeBlang |
| 2010/0236707 | A1 | 9/2010 | Studer et al. |
| 2011/0078977 | A1 | 4/2011 | Martensson |
| 2011/0167751 | A1 | 7/2011 | Engstrom |
| 2011/0173914 | A1 | 7/2011 | Engstrom |
| 2011/0185663 | A1 | 8/2011 | Martensson |
| 2011/0271631 | A1 | 11/2011 | Engstrom |
| 2011/0271632 | A1 | 11/2011 | Cappelle et al. |
| 2011/0293361 | A1 | 12/2011 | Olofsson |
| 2012/0042595 | A1 | 2/2012 | De Boe |
| 2012/0055112 | A1 | 3/2012 | Engstrom |
| 2012/0216472 | A1 | 8/2012 | Martensson et al. |
| 2012/0233948 | A1 | 9/2012 | Palsson |
| 2012/0247053 | A1 | 10/2012 | Martensson |
| 2012/0291396 | A1 | 11/2012 | Martensson |
| 2012/0304590 | A1 | 12/2012 | Engstrom |
| 2013/0042555 | A1 | 2/2013 | Martensson |
| 2013/0067840 | A1 | 3/2013 | Martensson |
| 2013/0291467 | A1 | 11/2013 | Palsson et al. |
| 2014/0137506 | A1 | 5/2014 | Palsson |
| 2014/0157711 | A1 | 6/2014 | Palsson et al. |
| 2014/0157721 | A1 | 6/2014 | Engstrom |
| 2014/0165493 | A1 | 6/2014 | Palsson et al. |

FOREIGN PATENT DOCUMENTS

| | | |
|---|---|---|
| BE | 417526 | 12/1936 |
| BE | 557844 | 3/1960 |
| BE | 1010339 | 6/1998 |
| BE | 10101487 | 10/1998 |
| CA | 991373 | 6/1976 |
| CA | 1169106 | 6/1984 |
| CA | 2226286 | 12/1997 |
| CA | 2252791 | 5/1999 |
| CA | 2289309 | 11/1999 |
| CH | 200949 | 1/1939 |
| CH | 211677 | 1/1941 |
| CH | 211877 | 1/1941 |
| CH | 562 377 | 5/1975 |
| DE | 209979 | 11/1906 |
| DE | 1212275 | 3/1966 |
| DE | 1985418 | 5/1968 |
| DE | 1534802 | 4/1970 |
| DE | 7102476 | 6/1971 |
| DE | 1534278 | 11/1971 |
| DE | 2101782 | 7/1972 |
| DE | 2145024 | 3/1973 |
| DE | 2159042 | 6/1973 |
| DE | 2238660 | 2/1974 |
| DE | 2251762 | 5/1974 |
| DE | 7402354 | 5/1974 |
| DE | 2502992 | 7/1976 |
| DE | 2616077 | 10/1977 |
| DE | 2917025 | 11/1980 |
| DE | 3104519 | 2/1981 |
| DE | 3041781 | 6/1982 |
| DE | 3214207 | 11/1982 |
| DE | 3246376 | 6/1984 |
| DE | 3304992 | 8/1984 |
| DE | 3306609 | 9/1984 |
| DE | 3319235 | 11/1984 |
| DE | 3343601 | 6/1985 |
| DE | 8604004 | 4/1986 |
| DE | 3512204 | 10/1986 |
| DE | 3544845 | 6/1987 |
| DE | 3631390 | 12/1987 |
| DE | 3640822 | 6/1988 |
| DE | 8600241 | 4/1989 |
| DE | 4002547-0 | 8/1991 |
| DE | 3932980 | 11/1991 |
| DE | 9300306 | 3/1993 |
| DE | 4134452 | 4/1993 |
| DE | 415273 | 11/1993 |
| DE | 4242530 | 6/1994 |
| DE | 43 44 089 | 7/1994 |
| DE | 9317191 | 3/1995 |
| DE | 296 14 086 | 10/1996 |
| DE | 29703962 | 6/1997 |
| DE | 29710175 | 8/1997 |
| DE | 29711960 | 10/1997 |
| DE | 19651149 | 6/1998 |
| DE | 19709641 | 9/1998 |
| DE | 19821938 | 11/1999 |
| DE | 20001225 | 7/2000 |
| DE | 19925248 | 12/2000 |

(56) References Cited

FOREIGN PATENT DOCUMENTS

| | | |
|---|---|---|
| DE | 20018284 | 1/2001 |
| DE | 20017461 | 2/2001 |
| DE | 20027461 | 3/2001 |
| DE | 100 01 076 | 10/2001 |
| DE | 517353 | 5/2002 |
| DE | 10062873 | 7/2002 |
| DE | 1013128 | 1/2003 |
| DE | 10 2005 002 297.9 | 8/2005 |
| DE | 10 2007 035 648 | 1/2009 |
| DE | 2009 022 483.1 | 5/2009 |
| DE | 20 2009 004 530 | 6/2009 |
| DE | 10 2010 004717.1 | 1/2010 |
| DE | 10 2010 020 089.1 | 5/2010 |
| DE | 10 2009 038 750 | 3/2011 |
| EM | 0969164 | 1/2000 |
| EP | 0085196 | 8/1983 |
| EP | 0248127 | 12/1987 |
| EP | 0220389 | 5/1992 |
| EP | 0623724 | 11/1994 |
| EP | 0652340 | 5/1995 |
| EP | 0698162 | 2/1996 |
| EP | 000711886 | 5/1996 |
| EP | 813641 | 12/1997 |
| EP | 0843763 | 5/1998 |
| EP | 0849416 | 6/1998 |
| EP | 0855482 | 7/1998 |
| EP | 0877130 | 11/1998 |
| EP | 0903451 | 3/1999 |
| EP | 0958441 | 11/1999 |
| EP | 0969163 | 1/2000 |
| EP | 0974713 | 1/2000 |
| EP | 1229181 | 8/2002 |
| EP | 2400076 | 8/2004 |
| EP | 2 034 106 | 3/2009 |
| FI | 843060 | 8/1984 |
| FR | 557844 | 8/1923 |
| FR | 1175582 | 3/1959 |
| FR | 1215852 | 4/1960 |
| FR | 1293043 | 5/1962 |
| FR | 2568295 | 1/1986 |
| FR | 2630149 | 10/1989 |
| FR | 2637932 | 4/1990 |
| FR | 2675174 | 10/1992 |
| FR | 2691491 | 11/1993 |
| FR | 2891491 | 11/1993 |
| FR | 2691691 | 12/1993 |
| FR | 2697275 | 4/1994 |
| FR | 2712329 | 5/1995 |
| FR | 2781513 | 1/2000 |
| FR | 2785633 | 5/2000 |
| GB | 424057 | 2/1935 |
| GB | 585205 | 1/1947 |
| GB | 599793 | 3/1948 |
| GB | 636423 | 4/1950 |
| GB | 812671 | 4/1959 |
| GB | 1212983 | 11/1970 |
| GB | 1237744 | 6/1971 |
| GB | 1348272 | 3/1974 |
| GB | 1430423 | 3/1976 |
| GB | 2117813 | 10/1983 |
| GB | 2126106 | 3/1984 |
| GB | 2142670 | 1/1985 |
| GB | 2168732 | 6/1986 |
| GB | 2167465 | 1/1989 |
| GB | 2228753 | 9/1990 |
| GB | 2443381 | 10/1991 |
| GB | 2256023 | 11/1992 |
| IT | 812671 | 4/1959 |
| JP | 5465528 | 5/1979 |
| JP | 57119056 | 7/1982 |
| JP | 64-14838 | 1/1989 |
| JP | 64-14839 | 1/1989 |
| JP | 1178659 | 7/1989 |
| JP | 02285145 | 11/1990 |
| JP | 3-18343 | 2/1991 |
| JP | 3-44645 | 4/1991 |
| JP | 3046645 | 4/1991 |
| JP | 3-110258 | 5/1991 |
| JP | 3169967 | 7/1991 |
| JP | 3-202550 | 9/1991 |
| JP | 4106264 | 4/1992 |
| JP | 4191001 | 7/1992 |
| JP | 04261955 | 9/1992 |
| JP | 5148984 | 6/1993 |
| JP | 6-146553 | 5/1994 |
| JP | 656310 | 8/1994 |
| JP | 6320510 | 11/1994 |
| JP | 752103 | 2/1995 |
| JP | 407052103 | 2/1995 |
| JP | 7076923 | 3/1995 |
| JP | 7180333 | 7/1995 |
| JP | 7229276 | 8/1995 |
| JP | 7279366 | 10/1995 |
| JP | 7300979 | 11/1995 |
| JP | 7310426 | 11/1995 |
| JP | 8086078 | 4/1996 |
| NL | 7601773 | 2/1975 |
| NO | 157871 | 7/1984 |
| NO | 305614 | 5/1995 |
| PL | 26931 | 6/1989 |
| SE | 372051 | 12/1974 |
| SE | 71149009-9 | 12/1974 |
| SE | 7706470 | 12/1978 |
| SE | 450141 | 6/1987 |
| SE | 8206934-5 | 6/1987 |
| SE | 457737 | 1/1989 |
| SE | 462809 | 4/1990 |
| SE | 467150 | 6/1992 |
| SE | 501014 | 10/1994 |
| SE | 9301595-6 | 11/1994 |
| SE | 502994 | 3/1996 |
| SE | 503861 | 9/1996 |
| SE | 509059 | 11/1998 |
| SE | 509060 | 11/1998 |
| SE | 512290 | 2/2000 |
| SE | 512313 | 2/2000 |
| SE | 513189 | 7/2000 |
| SE | 514645 | 3/2001 |
| SE | 0001149 | 10/2001 |
| SU | 363795 | 11/1973 |
| WO | WO 80/02155 | 10/1980 |
| WO | WO 84/02155 | 6/1984 |
| WO | WO 8703839 | 7/1987 |
| WO | WO 9217657 | 10/1992 |
| WO | WO 93/13280 | 7/1993 |
| WO | WO 9401628 | 1/1994 |
| WO | WO 9426999 | 11/1994 |
| WO | WO 96/12857 | 5/1996 |
| WO | WO 96/23942 | 8/1996 |
| WO | WO 9627719 | 9/1996 |
| WO | WO 9627721 | 9/1996 |
| WO | WO 9630177 | 10/1996 |
| WO | WO 9747834 | 12/1997 |
| WO | WO 9822678 | 5/1998 |
| WO | WO 9824994 | 6/1998 |
| WO | WO 9824995 | 6/1998 |
| WO | WO 9858142 | 12/1998 |
| WO | WO 9901628 | 1/1999 |
| WO | WO 9940273 | 8/1999 |
| WO | WO 9966151 | 12/1999 |
| WO | WO 9966152 | 12/1999 |
| WO | WO 0006854 | 2/2000 |
| WO | WO 00/20705 | 4/2000 |
| WO | WO 0056802 | 9/2000 |
| WO | WO 0063510 | 10/2000 |
| WO | WO 0066856 | 11/2000 |
| WO | WO 01/02669 | 1/2001 |
| WO | WO 0002214 | 3/2001 |
| WO | WO 0120101 | 3/2001 |
| WO | WO 01/31141 | 5/2001 |
| WO | WO 01/51732 | 7/2001 |
| WO | WO 01/51733 | 7/2001 |
| WO | WO 01/75247 | 10/2001 |
| WO | WO 2007/089186 | 8/2002 |

(56) References Cited

FOREIGN PATENT DOCUMENTS

| | | |
|---|---|---|
| WO | WO 02/081843 | 10/2002 |
| WO | WO 03/083234 | 10/2003 |
| WO | WO 03093686 | 11/2003 |
| WO | WO 2005/040521 | 5/2005 |
| WO | WO 2005/054599 | 6/2005 |
| WO | WO 2005/059269 | 6/2005 |
| WO | WO 2006/043893 | 4/2006 |
| WO | WO 2007/008139 | 1/2007 |
| WO | WO 2007/141605 | 12/2007 |
| WO | WO 2008/004960 | 1/2008 |
| WO | WO 2009/066153 | 5/2009 |
| WO | WO 2009/139687 | 11/2009 |
| WO | WO 2010/082171 | 7/2010 |
| WO | WO 2010/136171 | 12/2010 |
| WO | WO 2011/085788 | 7/2011 |
| WO | WO 2011/141043 | 11/2011 |

OTHER PUBLICATIONS

Traditional Details; For Building Restoration, Renovation, and Rehabilitation: From the 1932-1951 Editions of Architectvral Graphic Standards; John Wiley & Sons, Inc.
Traindustrins Handbok "Snickeriarbete", Knut Larsson, Tekno's Handbocker Publikation 12-11 (1952).
Elements of Rolling Practice; The United Steel Companies Limited Sheffield, England, 1963; pp. 116-117.
Die mobile; Terbrack; 1968.
High-Production Roll Forming; Society of Manufacturing Engineers Marketing Services Depmiment; pp. 189-192; George T. Halmos; 1983.
Fundamentals of Building Construction Materials and Methods; Copyright 1985; pp. 11.
Automated Program of Designing Snap-fits; Aug. 1987; pp. 3.
Plastic Part Technology; 1991; pp. 161-162.
Technoscope; Modern Plastics, Aug. 1991; pp. 29-30.
Encyclopedia of Wood Joints; A Fine Woodworking Book; pp. 1-151; 1992.
Whittington's Dictionary of Plastics; Edited by James F. Carley, Ph.D., PE; pp, 443, 461; 1993.
Patent Mit Inter-nationalem, Die Revolution ((von Grund auf)) Fibo-Trespo, Disstributed at the Domotex fair in Hannover, Germany in Jan. 1996.
Focus, Information Till Ana Medabetare, Jan. 2001, Kahrs pa Domotex I Hmmover, Tysklm1d, Jan. 13-16, 2001.
Search Report dated Apr. 21, 2001.
Letter to the USPTO dated May 14, 2002, regarding U.S. Appl. No. 90/005,744.
Non-Final Office Action for U.S. Appl. No. 10/270,163 dated Dec. 10, 2004.
Final Office Action for U.S. Appl. No. 10/270,163 dated Jun. 2, 2005.
Non-Final Office Action for U.S. Appl. No. 10/270,163 dated Dec. 14, 2005.
Final Office Action for U.S. Appl. No. 10/270,163 dated May 25, 2006.
Non-Final Office Action for U.S. Appl. No. 11/185,724 dated Sep. 26, 2006.
Non-Final Office Action for U.S. Appl. No. 11/483,636 dated Oct. 11, 2006.
Reexamination No. 90/007, 366 dated Oct. 24, 2006.
Reexamination No. 90/007, 526 dated Dec. 5, 2006.
Non-Final Office Action for U.S. Appl. No. 11/185,724 dated Apr. 19, 2007.
Non-Final Office Action for U.S. Appl. No. 11/483,636 dated Apr. 19, 2007.
Non-Final Office Action for U.S. Appl. No. 11/015,741 dated Sep. 6, 2007.
Non-Final Office Action for U.S. Appl. No. 11/242,127 dated Nov. 1, 2007.
Non-Final Office Action for U.S. Appl. No. 11/185,724 dated Jan. 9, 2008.
Final Office Action for U.S. Appl. No. 11/015,741 dated Feb. 26, 2008.
Non-Final Office Action for U.S. Appl. No. 11/483,636 dated Apr. 3, 2008.
Non-Final Office Action for U.S. Appl. No. 11/242,127 dated Apr. 29, 2008.
United States District Court Eastern District of Wisconsin; Order; Dated May 1, 2008.
Examiner Interview Summary for U.S. Appl. No. 11/015,741 dated May 7, 2008.
Final Office Action for U.S. Appl. No. 11/185,724 dated Jul. 9, 2008.
Non-Final Office Action for U.S. Appl. No. 10/580,191 dated Jul. 16, 2008.
Reexamination No. 90/007, 365 dated Aug. 5, 2008.
United States District Court Eastern District of Wisconsin; Judgment; Dated Oct. 10, 2008.
United States District Court Eastern District of Wisconsin; Order; Dated Oct. 10, 2008.
Final Office Action for U.S. Appl. No. 11/483,636 dated Nov. 20, 2008.
United States District Court Eastern District of Wisconsin; Order; Dated Dec. 31, 2008.
Non-Final Office Action for U.S. Appl. No. 11/242,127 dated Mar. 31, 2009.
Non-Final Office Action for U.S. Appl. No. 12/010,587 dated Jun. 23, 2009.
Non-Final Office Action for U.S. Appl. No. 11/483,636 dated Jul. 21, 2009.
Non-Final Office Action for U.S. Appl. No. 12/010,587 dated Oct. 10, 2012.
Examiner Interview Summary for U.S. Appl. No. 11/185,724 dated Aug. 13, 2009.
Non-Final Office Action for U.S. Appl. No. 12/278,274 dated Sep. 24, 2009.
Final Office Action for U.S. Appl. No. 11/242,127 dated Nov. 24, 2009.
United States Court of Appeals for Federal Circuit; 2009-1107,-1122; Decided: Feb. 18, 2010.
Appeals from the United States District Court for the Eastern District of Wisconsin; Consolidated case No. 02-CV-0736 and 03-CV-616; Judge J.P. Stadtmueller, 2009-1107,-122. Revised Feb. 25, 2010.
Non-Final Office Action for U.S. Appl. No. 10/580,191 dated Mar. 10, 2010.
Non-Final Office Action for U.S. Appl. No. 11/483,636 dated Mar. 17, 2010.
United States Court of Appeals of the Federal Circuit; Case No. 02-CV-0736 and 03-CV-616; Mandate issued on Apr. 12, 2010; Judgment; 2 pages.
Final Office Action for U.S. Appl. No. 12/278,274 dated May 17, 2010.
Final Office Action for U.S. Appl. No. 12/010,587 dated May 25, 2010.
Final Office Action for U.S. Appl. No. 10/580,191 dated Oct. 6, 2010.
Non-Final Office Action for U.S. Appl. No. 12/278,274 dated Nov. 2, 2010.
Non-Final Office Action for U.S. Appl. No. 11/483,636 dated Dec. 7, 2010.
Non-Final Office Action for U.S. Appl. No. 12/010,587 dated Mar. 16, 2011.
Final Office Action for U.S. Appl. No. 12/278,274 dated Apr. 14, 2011.
Final Office Action for U.S. Appl. No. 11/483,636 dated May 24, 2011.
Non-Final Office Action for U.S. Appl. No. 13/048,646 dated May 25, 2011.
Non-Final Office Action for U.S. Appl. No. 12/966,861 dated Jul. 20, 2011.
Non-Final Office Action for U.S. Appl. No. 12/979,086 dated Aug. 3, 2011.
Non-Final Office Action for U.S. Appl. No. 12/010,587 dated Aug. 30, 2011.
Non-Final Office Action for U.S. Appl. No. 11/483,636 dated Sep. 28, 2011.

(56) References Cited

OTHER PUBLICATIONS

Decision revoking the European Patent EP-B-1 276 941 dated Oct. 21, 2011.
Final Office Action for U.S. Appl. No. 13/048,646 dated Nov. 1, 2011.
Final Office Action for U.S. Appl. No. 12/966,861 dated Jan. 20, 2012.
Final Office Action for U.S. Appl. No. 12/979,086 dated Jan. 25, 2012.
Final Office Action for U.S. Appl No. 11/483,636 dated Feb. 7, 2012.
Non-Final Office Action for U.S. Appl. No. 12/966,797 dated Feb. 29, 2012.
Final Office Action for U.S. Appl. No. 13/204,481 dated Mar. 12, 2012.
Notice of Allowance for U.S. Appl. No. 12/966,861 dated Apr. 11, 2012.
Non-Final Office Action for U.S. Appl. No. 13/437,597 dated Jul. 9, 2012.
Notice of Allowance for U.S. Appl. No. 12/979,086 dated Jul. 19, 2012.
Non-final Office Action for U.S. Appl. No. 12/747,454 dated Aug. 6, 2012.
Final Office Action for U.S. Appl. No. 12/966,797 dated Aug. 8, 2012.
Non-Final Office Action for U.S. Appl. No. 13/452,183 dated Aug. 8, 2012.
Non-Final Office Action for U.S. Appl. No. 13/204,481 dated Sep. 7, 2012.
Non-Final Office Action for U.S. Appl. No. 13/567,933 dated Sep. 12, 2012.
Non-Final Office Action for U.S. Appl. No. 11/483,636 dated Oct. 10, 2012.
Advisory Action for U.S. Appl. No. 12/966,797 dated Oct. 18, 2012.
European Office Action dated Oct. 19, 2012.
Notice of Allowance for U.S. Appl. No. 13/437,597 dated Oct. 26, 2012.
Non-Final Office Action for U.S. Appl. No. 13/086,931 dated Nov. 7, 2012.
Non-Final Office Action for U.S. Appl. No. 13/492,512 dated Nov. 21, 2012.
Non-Final Office Action for U.S. Appl. No. 13/463,329 dated Nov. 21, 2012.
Notice of Allowance for U.S. Appl. No. 11/483,636 dated Nov. 23, 2012.
Notice of Allowance for U.S. Appl. No. 10/270,163 dated Dec. 13, 2012.
Non-Final Office Action for U.S. Appl. No. 12/966,797 dated Dec. 13, 2012.
Non-Final Office Action for U.S. Appl. No. 13/559,230 dated Dec. 20, 2012.
Non-Final Office Action for U.S. Appl. No. 13/675,936 dated Dec. 31, 2012.
Notice of Allowability for U.S. Appl. No. 11/483,636 dated Jan. 3, 2013.
Notice of Allowance for U.S. Appl. No. 12/747,454 dated Jan. 8, 2013.
Notice of Allowance for U.S. Appl. No. 13/437,597 dated Jan. 9, 2013.
Final Office Action for U.S. Appl. No. 12/010,587 dated Jan. 28, 2013.
Non-Final Office Action for U.S. Appl. No. 13/620,098 dated Feb. 8, 2013.
Final Office Action for U.S. Appl. No. 13/204,481 dated Feb. 25, 2013.
Non-Final Office Action for U.S. Appl. No. 13/492,512 dated Feb. 26, 2013.
Non-Final Office Action for U.S. Appl. No. 11/015,741 dated Mar. 13, 2013.
Final Office Action for U.S. Appl. No. 13/567,933 dated Mar. 15, 2013.
Notice of Allowance for U.S. Appl. No. 11/242,127 dated Apr. 26, 2013.
Non-Final Office Action for U.S. Appl. No. 12/747,454 dated May 10, 2013.
Non-Final Office Action for U.S. Appl. No. 13/559,242 dated Jun. 7, 2013.
Applicant-Iniated Interview Summary for U.S. Appl. No. 13/204,481 dated Jul. 29, 2013.
Corrected Notice of Allowability for U.S. Appl. No. 11/185,724 dated Aug. 1, 2013.
Final Office Action for U.S. Appl. No. 13/086,931 dated Aug. 5, 2013.
Notice of Allowance for U.S. Appl. No. 12/966,797 dated Aug. 7, 2013.
Notice of Allowance for U.S. Appl. No. 12/010,587 dated Aug. 14, 2013.
Notice of Allowance for U.S. Appl. No. 13/559,230 dated Aug. 20, 2013.
Non-Final Office Action for U.S. Appl. No. 13/860,315 dated Aug. 26, 2013.
Notice of Allowance for U.S. Appl. No. 11/185,724 dated Sep. 3, 2013.
Non-Final Office Action for U.S. Appl. No. 13/204,481 dated Sep. 4, 2013.
Final Office Action for U.S. Appl. No. 13/620,098 dated Sep. 24, 2013.
Non-Final Office Action for U.S. Appl. No. 13/463,329 dated Sep. 25, 2013.
Notice of Allowance for U.S. Appl. No. 13/675,936 dated Sep. 25, 2013.
Supplemental Notice of Allowance for U.S. Appl. No. 12/966,797 dated Oct. 3, 2013.
Supplemental Notice of Allowance for U.S. Appl. No. 13/559,230 dated Oct. 4, 2013.
Notice of Allowance for U.S. Appl. No. 11/185,724 dated Nov. 1, 2013.
Final Office Action for U.S. Appl. No. 12/747,454 dated Nov. 6, 2013.
Notice of Allowance for U.S. Appl. No. 13/086,931 dated Nov. 19, 2013.
Pending U.S. Appl. No. 09/672,077 (Cited As US 6,536,178).
Pending U.S. Appl. No. 09/988,014 (Cited As US 2003/0094230).
Pending U.S. Appl. No. 09/770,395 (Cited As US 6,588,166).
Pending U.S. Appl. No. 10/158,945 (Cited As US 7,497,058).
Pending U.S. Appl. No. 09/672,076 (Cited As US 6,591,568).
Final Office Action for U.S. Appl. No. 12/747,454 dated Feb. 24, 2014.
Supplemental Notice of Allowance for U.S. Appl. No. 13/086,931 dated Apr. 14, 2014.
Abandoned U.S. Appl. No. 13/420,282 dated Mar. 14, 2012.
Pending U.S. Appl. No. 14/223,365 dated Mar. 24, 2014.
Non-Final Office Action for U.S. Appl. No. 14/098,187 dated Jun. 16, 2014.

* cited by examiner

SET OF PANELS

CROSS REFERENCE TO RELATED APPLICATIONS

This application is a continuation of and claims priority to U.S. patent application Ser. No. 13/086,931, filed Apr. 14, 2011, which claims priority to German Patent application No. 102010020089.1 filed May 10, 2010, the entire disclosures of which are incorporated herein by reference in their entireties.

DESCRIPTION

The invention relates to asset of panels comprising a first panel and at least a second panel, wherein the panels are respectively provided with a first edge and with a second edge and wherein the first edge of the first panel and the second edge of the second panel are configured to establish a connection between the first and the second panel.

Such a set of panels is known, for example, from WO 00/47841. In this case, a first edge has a lower lip with a step, while a second edge has a downwardly open locking groove. In a connected state of the panels, the step cooperates with the downwardly open locking groove so that a positive-fit connection in a horizontal direction is formed. By means of a relative movement of the panels with respect to each other, the two edges can in this case be connected vertically relative to the plane of laying.

In order to lock the panels vertically relative to the plane of laying, a separate clip is provided, which is attached to one of the edges and has a moveable clip head, which in the connected state of the panels cooperates with a locking surface on the other edge.

A connection as described in WO 00/47841 can advantageously be used in floor panels. It facilitates the laying of the floor panels because the floor panels can be locked with each other by a simple downward movement of one of the panels.

However, there is a need for an improvement of the edges including the clip with regard to the joint strength and to further simplify their manufacture.

The invention is therefore based on the object of providing a set of panels, the edges of which can be connected with each other, wherein the connection between the edges has good properties and is comparatively simple to produce.

The object on which the invention is based is achieved with the combination of features of claim 1. Preferred exemplary embodiments can be found in the dependent claims.

According to claim 1, it is provided that the clip head, in a locking position, exerts a force on a locking surface of the second edge which urges the second edge of the second panel against the lower lip of the first edge of the first panel, wherein the locking position lies between an undeformed initial position and an assembly position. In this case, the assembly position is the position in which the clip is maximally deformed when the profiles are connected. Preferably, the locking position is closer to the assembly position than to the initial position.

This means that the clip continues to remain deformed in the locking position. Due an appropriate configuration of the clip head, and the locking surface cooperating with the clip head, it can be ensured that, even given certain manufacturing tolerance's, the clip head always rests securely against the locking surface and exerts a force due to which the one lower contact surface of the second edge rests securely on a contact surface of the lower lip of the first edge.

As was already explained, the locking position in a preferred embodiment is closer to the assembly position than to the initial position. If, for example, the deformation (deformation work) in the assembly position is set to 100%, then in a preferred embodiment, the deformation in the locking position is supposed to be at least 50%. Furthermore, in a preferred embodiment, the deformation in the locking position, relative to the maximum deformation in the assembly position; may exceed 60 or even exceed 70%.

In a preferred embodiment, the clip is inserted, with a fastening area, in a dip groove having a lower groove wall, an upper groove wall and a groove bottom. In this case, in a preferred embodiment, the dip head does not protrude beyond an imaginary extension of the lower groove wall in the initial position, wherein the dip head sweeps over this imaginary extension during the movement, starting from the initial position into the assembly position.

In addition, it can be provided that the dip including the clip head, does not protrude beyond an imaginary extension of the upper groove wall.

Preferably, the upper groove wall and the lower groove wall are parallel to each other. The upper groove wall and the lower groove wall can in this case be parallel to the plane of laying or can also include an angle. The angle can be, for example 0° to 20°.

When the panels are connected, the movable clip head can execute a pivoting movement about a pivot axis located between the lower and upper groove wall or between their imaginary extensions. In this case, the pivot axis preferably extends along the edges.

The fastening area can have four fastening surfaces separate from one another, of which two cooperate with the upper groove wall and the other two with the lower groove wall. Preferably, the four fastening surfaces, in the direction of the groove bottom, are in this case arranged offset relative to one another. The cross section of the fastening area in this case approximately has a zigzag shape on which the moveable clip head is formed to be pivotable.

A fifth fastening surface of the fastening area can be provided, which rests against the groove bottom. The fifth fastening surface thus ensures, that the dip is fixed in the direction of the groove bottom.

The invention will now be explained in more detail with reference to an exemplary embodiment shown in the figures. In the figures.

Figure 1:
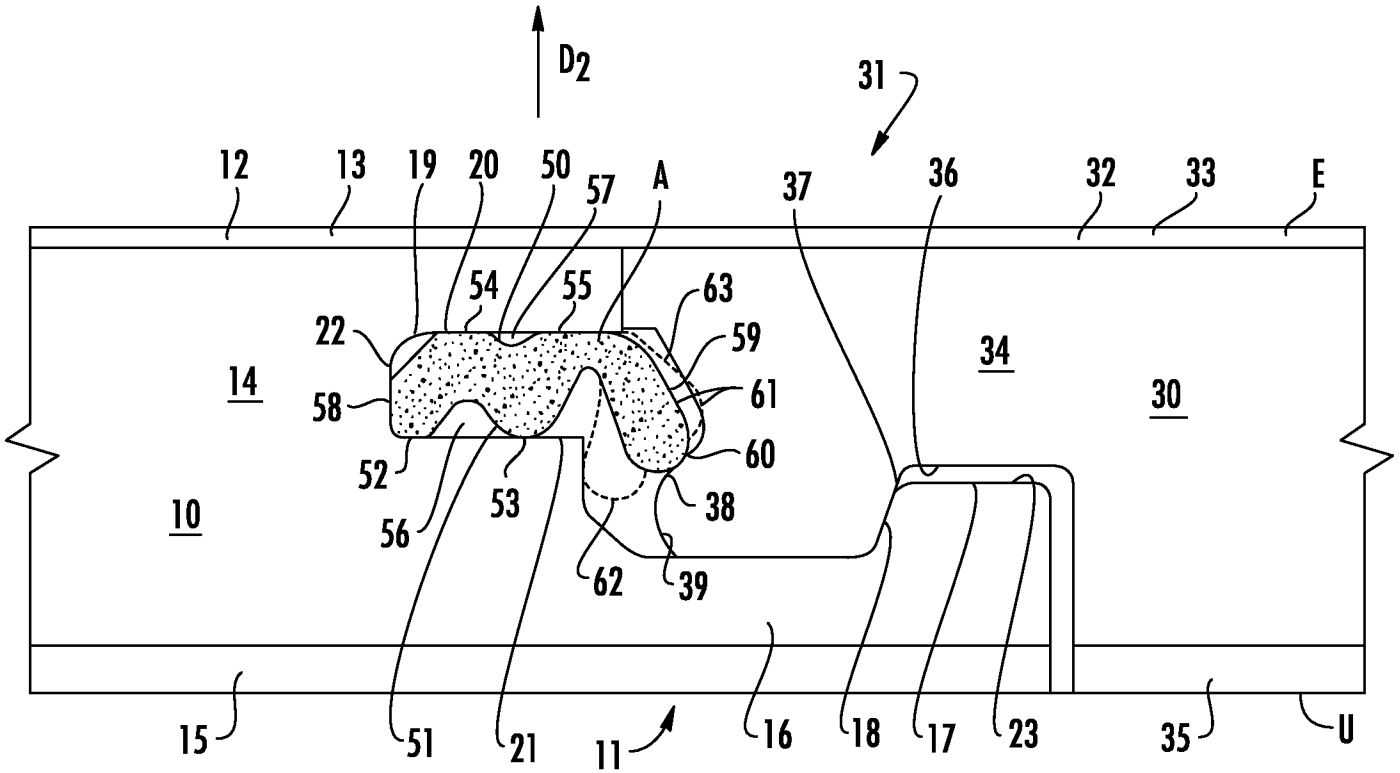
FIG. 1 shows two panels in the connected state.

FIG. 1 shows a cross section of a detail of a first panel 10 and a second panel 30, each of which are supposed to have a rectangular basic shape. It can be seen in FIG. 1 that the first panel 10 has a first edge 11 cooperating with a second edge 31 of the second panel 30. The first panel 10 in this case also has a second edge which corresponds to the second edge 31 of the second panel 30 but is not shown in FIG. 1. The same applies, mutatis mutandis, to the second panel 30, which also has a first edge which is not shown and corresponds to the first edge 11 of the first panel 10. Preferably, the first edge and the second edge are disposed opposite to one another on a panel.

The panels 10, 30 preferably are floor panels resting on an underlying floor U. A plane of laying E, in which the upper sides 12, 32 of the panels 10, 30 lie, extends parallel to the underlying floor U. The upper sides 12, 32 in this case comprise a decorative layer 13, 33 attached to a core 14 and 34, respectively. The core 14, 34 can consist of MDF or HDF, but can also be formed from a different material.

On an underside, the panel 10 has an underlayer 15. The corresponding underlayer of the constructionally identical panel 30 is designated with the reference numeral 35.

The first edge 11 has a lower lip 16 with a step 17 forming a substantially vertical locking surface 18.

In the connected state of the panels 10, 30 or the edges 11, 31 as it is shown in FIG. 1, the step 17 reaches into a locking groove 36 of the second edge 31 open towards the underlying floor U. The locking groove has in this case a substantially vertical locking surface 37 which cooperates with the locking surface 18 of the step 17. The cooperation of the substantially vertical surfaces 18, 37 prevents the second panel 30 from being detachable from the first panel 10 in the direction D1, i.e. parallel to the plane of laying E.

A lock of the panels 10, 30 in the vertical direction D2 is ensured by a clip, which in its entirety is designated with 50. In this case, in the example of the floor panels, the vertical direction D2 is perpendicular to the plane of laying E.

The clip comprises a fastening area 51 which is disposed in a clip groove 19 of the first panel 10. The clip groove 19 has an upper groove wall 20 and a lower groove wall 21, both of which extend parallel to the plane of laying E. In addition, the clip groove 19 has a groove bottom 22.

The fastening area 51 of the clip 50 has four fastening surfaces 52, 53, 54, 55 separate from one another, with lower fastening surfaces resting against the lower groove wall 21 and upper fastening surfaces 54, 55 resting against the upper groove wall 20. There is an interstice 56 between the lower fastening surfaces 52, 53. Such an interstice can also be found between the upper fastening surfaces 54, 55 and is designated with 57. The fastening surfaces 52, 53, 54, 55, in the direction of the groove bottom, or in this case in the direction D1, are arranged offset relative to one another. The clip 50, which is preferably of plastic, but which cart also consist of MDF or HDF, thus as a certain resilience or compressibility between the groove walls 20, 21, which can be utilized for clamping the clip 50 into the groove 19 in a simple manner.

A fifth fastening surface 58 adjoining to the lower fastening surface 52, rests against the groove bottom 22 and ensures a fixation of the clip in the groove 19 in the horizontal direction or in the direction opposite to the direction D1.

Moreover, the clip 50 has a pivotable clip head 59 which is which is connected to the fastening area 51 of the clip 50 so as to be pivotable about a pivoting axis A. FIG. 1 in this case shows the dip head 59 in a locking position in which the clip head 59, with a head end 60, rests against a locking surface 38 of the second edge 31. The head end 60 in this case has an approximately semi-circular configuration. In the direction towards the underlying floor U, the locking surface 38 transitions into a sliding surface 39, along which the clip head 59 slides with a sliding face 61 when the panels 10, 30 are connected with each other by means of a vertical downward movement of the second panel 30. The sliding surface 39 in this case transitions into the locking surface 38 without any appreciable edges or steps.

In addition, FIG. 1 indicates two further positions of the clip head 59, which are in each case shown by means of dashed lines. The locking head 59 can assume an assembly position 62 in the process, so that the second edge 31, when the panels are connected, can be lowered, to the extent that it abuts against the lower lip 16 of the first edge 11. However, the clip head 59 is strongly deformed in the assembly position 62 so that the restoring forces urge the clip head upwards again until the clip head 59 is clamped against the locking surface 38 with its head end 60.

Furthermore, the initial position 63, in which the clip head 59 and the clip 50, respectively, are undeformed, can be seen in FIG. 1. It can be clearly seen that the locking position deviates from the initial position. This means that the clip 50 is still deformed in the locking position, and that this deformation ensures that the clip head 59, with its head end 60, presses-against the locking surface 38. This leads to the clip head 59 pressing the second edge 31 against the lower lip 16, via the locking surface 38.

Figure 2:
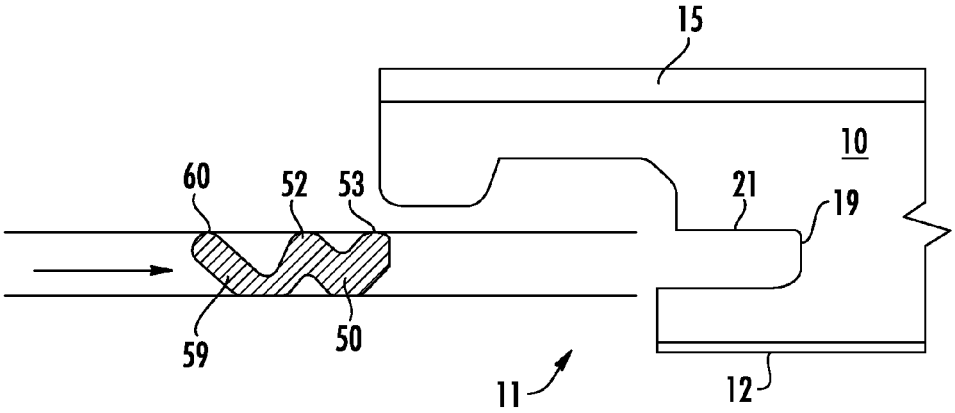
FIG. 2 shows a clip during insertion into a clip groove.

FIG. 2 shows the panel 10 with its edge 11, with the panel now standing-on its head, so that the lower side 12 is disposed at the bottom and the underlayer 15 at the top. FIG. 2 shows how the dip 50 can be inserted into the groove 19 by means of a linear movement. In this case, the clip 50 is in the undeformed state, with the dip head 59 assuming the initial position 63 (see FIG. 1). In this state, the lower fastening surfaces 52, 53 of the fastening area 51 of the clip 50 and the head end 60 lie in an extension of the lower groove wall 21.

As it is shown in FIG. 2, the clip can be reeled off a drum prior to insertion into the groove 21. Because of its shape, in which the fastening areas 52, 53 and the head end 60 on the one hand, and the fastening areas 59, 50 on the other hand respectively lie in one line, the clip 50 can be reeled onto a drum without any appreciable warping.

It can be seen from FIG. 1, that, seen in the vertical direction, the head end 60, at least in the assembly position 62 of the clip head 59, lies below a plane parallel to the plane of laying E, in which an upper surface 23 of the step 17 lies.

Due to the above-mentioned zigzag shape, the clip has a maximal material thickness which is smaller than the distance of the groove walls 20, 21. Apart from a constricted area near the pivoting axis A, by means of which the pivotability of the clip head 59 relative to the fastening area 51 is adjusted, the material thickness varies only very little. It is thus possible for the clip produced according to the preferred production by means of the extrusion process to be uniformly and quickly-cooled off.

The invention claimed is:

1. A set of floor panels, said set of floor panels comprising a first panel and at least a second panel;

wherein the first panel comprises a first edge;

wherein the second panel comprises a second edge, the first edge and the second edge configured to establish a connection between the first and second panel;

wherein the first edge has a distally protruding lower lip;

wherein said first edge and second edge comprise horizontally active locking surfaces that in a connected condition of the panels cooperate with each other to thereby provide a locking in a direction in a plane of the floor panels and perpendicular to the first and second edges, the horizontally active locking surface of the first edge being located at said distally protruding lower lip, whereas the horizontally active locking surface of the second edge is provided at a lower side of the second panel;

wherein said second edge is adapted to connect with the first edge via a relative vertical movement between the first and the second panels;

wherein a separate deformable clip is disposed in a groove in the first edge, said clip having a moveable clip head which in the connected state of the panels cooperates with a vertically active locking surface at the second edge, thereby locking the panels in a direction perpendicular to the plane of the panels;

wherein the moveable clip head, considered in a cross-section, is elastically moveable between at least an initial position wherein the moveable clip is in a free condition and an assembly position in which the clip is maximally deformed during connecting the panels;

wherein said groove in which said separate clip is provided has an upper groove wall and a lower groove wall;

wherein said upper groove wall and lower groove wall are substantially parallel to each other and include an angle in respect to the plane of the connected floor panels, the groove thereby forming an inclined seat for the clip;

wherein the clip is fastened into the groove by a fastening area;

wherein said fastening area by a clamping action via fastening surfaces cooperates with the inclined walls of said groove; and wherein the clip head does not protrude beyond an imaginary extension of the lower groove wall in the initial position.

2. The set of floor panels of claim 1, wherein said clip at said fastening area, when viewed in cross-section perpendicular to a length direction of the first edge, comprises one or more local fastening surfaces.

3. The set of floor panels of claim 2, wherein said one or more local fastening surfaces, seen in said cross-section, are configured as rounded protrusions.

4. The set of floor panels of claim 2, wherein the clip is configured such that at least one of said fastening surfaces and a moveable distal portion of the clip head are present in one single cross-section perpendicular to the length of the first edge.

5. The set of floor panels of claim 3, wherein the clip is configured such that at least one of said fastening surfaces and a moveable distal portion of the clip head are present in one single cross-section perpendicular to the length of the first edge.

6. The set of floor panels of claim 1, wherein the clip is configured such that at least one of said fastening surfaces and a moveable distal portion of the clip head are present in one single cross-section perpendicular to the length of the first edge.

7. The set of floor panels of claim 1, wherein the moveable clip head can adopt at least three positions, namely the initial position, the assembly position, and a locking position, wherein said locking position being the position in the connected condition of the panels and being located in between the initial position and the assembly position.

8. The set of floor panels of claim 7, wherein the clip head in said locking position exerts a force on the vertically active locking surface which urges the second edge of the second panel against the first edge of the first panel.

9. The set of floor panels of claim 1, wherein the fastening area has four fastening surfaces spaced apart from one another, of which two engage the upper inclined groove wall and the other two engage the lower inclined groove wall.

10. The set of floor panels of claim 1, wherein the clip head is pivotable.

11. The set of floor panels of claim 10, wherein the clip comprises a substantially uniform body thickness with the exception of a constricted portion defining a pivot point for the clip head.

12. The set of floor panels of claim 1, wherein said horizontally active locking surfaces are inclined in respect to the plane of the floor panels, and wherein said vertically active locking surface of the second edge is inclined at approximately 45 degrees.

13. The set of floor panels of claim 12, wherein said horizontally active locking surfaces have an inclination that is steeper than the inclination of the vertically active locking surface of the second edge.

* * * * *